US005467844A

United States Patent [19]

Powell et al.

[11] Patent Number: 5,467,844

[45] Date of Patent: Nov. 21, 1995

[54] ASSIGNING A HALL CALL TO A FULL ELEVATOR CAR

[75] Inventors: Bruce A. Powell, Canton; Jannah Stanley, Cromwell; Bertram F. Kupersmith, Avon, all of Conn.; Masanori Sahara, Yamato; Paul Simcik, Kawasaki, both of Japan; Zuhair S. Bahjat, Farmington, Conn.

[73] Assignee: Otis Elevator Company, Farmington, Conn.

[21] Appl. No.: 287,404

[22] Filed: Jul. 28, 1994

Related U.S. Application Data

[63] Continuation of Ser. No. 881,751, Dec. 20, 1991, abandoned.

[51] Int. Cl.[6] ..... B66B 1/20; B66B 1/18

[52] U.S. Cl. ..... 187/387; 187/383

[58] Field of Search ..... 187/380, 381, 187/382, 387, 392

[56] References Cited

U.S. PATENT DOCUMENTS 5,022,497 6/1991 Thanagavelu ..... 187/124

5,024,295 6/1991 Thangavelu ..... 187/125

*Primary Examiner*—Peter S. Wong

*Assistant Examiner*—Robert Nappi

[57] ABSTRACT

Deeming a full elevator car available for servicing a hall call is accomplished by testing if all of the car calls for the car are between the position of the elevator car and the hall call. If not, the full car may still be deemed available if there is a special stop car call between the position of the car and the position of the hall call or if there is at least one car call between the position of the car and the position of the hall call and there are no other hall calls between the position of the car and the position of the hall call.

4 Claims, 2 Drawing Sheets

ASSIGNING A HALL CALL TO A FULL ELEVATOR CAR

This application is a continuation application of Ser. No. 07/881,751 filed Dec. 20, 1991, now abandoned.

TECHNICAL FIELD

This invention relates to the field of elevator car dispatching.

BACKGROUND ART

Elevator dispatching software causes a particular elevator car in a bank of elevators to be sent to a floor in response to a user pressing a hall call button at that floor. Traditionally, a hall lantern will illuminate just prior to the car doors opening in order to inform the user as to which car will service his call. The dispatching software chooses which car to assign to the call according to a variety of elevator system parameters, such as average waiting time, maximum waiting time, average travel time, etc. It is possible for the values of these system parameters to change between the time the call is registered and the time the call is serviced. Therefore the software may reassign the call to other cars many times before the call is serviced. The user does not notice the reassignment because the hall lantern is lit only just before the car arrives.

Unlike traditional car assignment techniques, instantaneous car assignment (ICA) informs a user instantaneously (or shortly thereafter) as to which car will service his hall call. The ICA assignment technique is more demanding in that it is not acceptable to repeatedly reassign different cars to a hall call since this will cause continuous lighting and unlighting of hall lanterns causing confusion for the hall passengers. Accordingly, it is important to provide an initial assignment that is as good as possible. This includes anticipating if presently full elevator cars will not be full upon reaching a hall call.

DISCLOSURE OF INVENTION

Objects of the invention include improved assignment of an elevator car to a hall call.

According to the present invention, a full elevator car is deemed available for assignment to service a hall call if all car calls for the car are between the position of the car and the position of the hall call. According further to the present invention, a full elevator car is deemed available for assignment to service a hall call if there is a special stop car call between the position of the car and the position of the hall call. According further to the present invention, a full elevator car is deemed available for assignment to service a hall call if at least one car call for the car is between the position of the car and the position of the hall call and there are no other hall calls between the position of the elevator car and the position of the hall call.

The foregoing and other objects, features and advantages of the present invention will become more apparent in light of the following detailed description of exemplary embodiments thereof, as illustrated in the accompanying drawings.

BEST MODE FOR CARRYING OUT THE INVENTION

Figure 1:
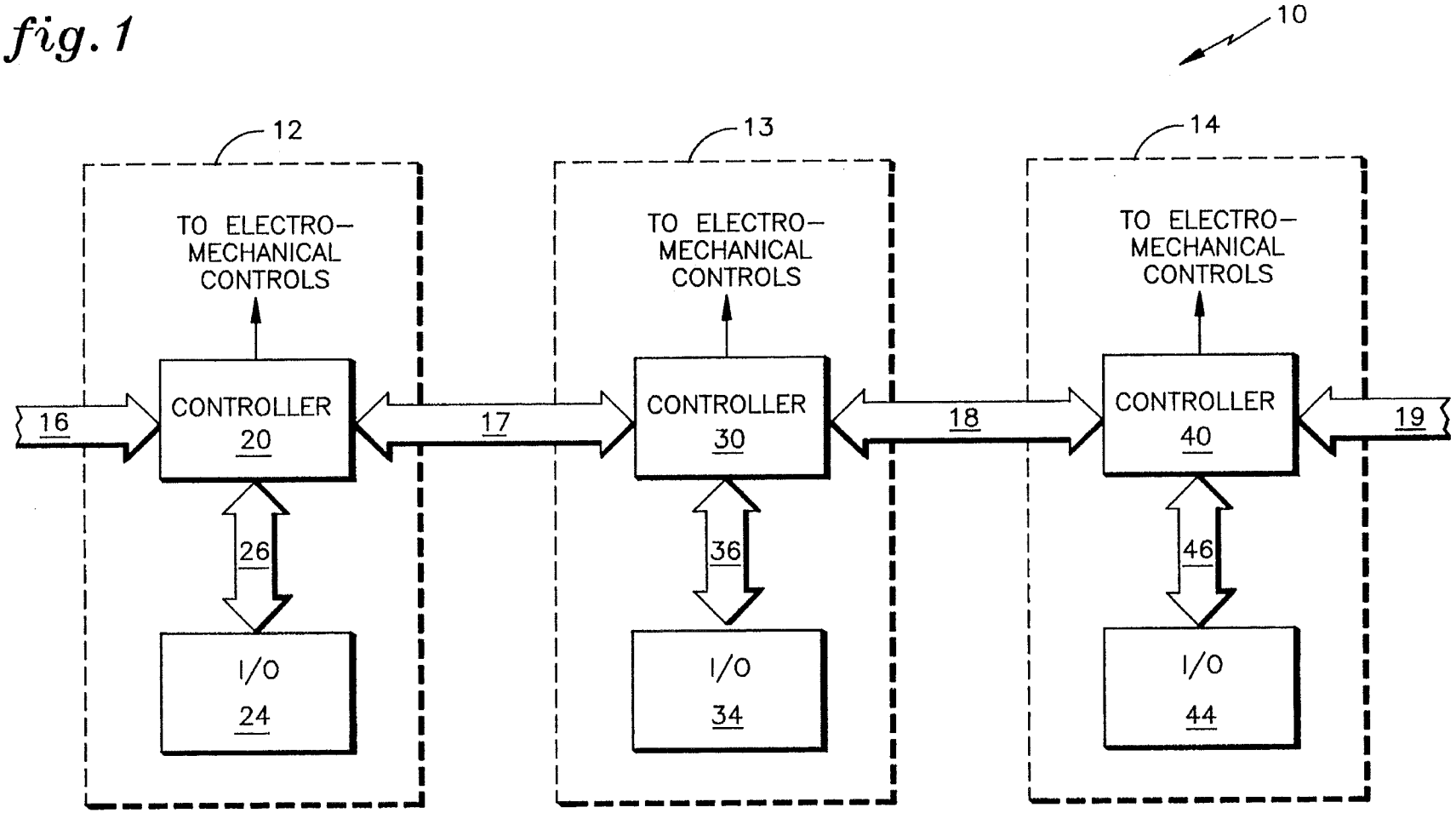
FIG. 1 is a schematic block diagram of an elevator system.

Referring to FIG. 1, an elevator group 10 comprises a first elevator 12, a second elevator 13, and a third elevator 14. Digital communication between the elevators 12–14 is provided by interelevator communication links 16–19, which are implemented by means known to those skilled in the art. The group 10 may also be composed of other elevators (not shown) which communicate with the first and third elevators 12, 14 via the interelevator communication links 16, 19 attached thereto. A remote elevator communications interface (not shown), which provides for interfacing the group 10 with a remote computer, may also be used.

The first elevator 12 comprises a microprocessor-based controller 20 which provides signals to electromechanical controls (not shown) for actuating electromechanical devices (not shown) that move an elevator car (not shown). The controller 20 also sends and receives signals to and from elevator input/output devices 24, such as hall and car call buttons, hall lanterns, floor indicators, etc. via an intraelevator communications link 26, the implementation of which is known to those skilled in the art. The second and third elevators 13, 14 are similarly configured with microprocessor based controllers 30, 40, input/output devices 34, 44, and intraelevator communications links 36, 46.

Elevator control and dispatching is implemented using software embedded in ROMs (not shown) in the controllers 20, 30, 40 and executed by microprocessors (not shown) also located within the controllers 20, 30, 40. The software receives and processes signals from the input/output devices 26, 36, 46, such as car and hall call buttons, and provides signals for actuating electromechanical controls to move the cars to various floors.

When a hall call is registered, a signal is sent to each of the controllers 20, 30, 40 via either the intraelevator communication links 26, 36, 46 or via the interelevator communication links 16–19. In response to a hall call signal, the controllers 20, 30, 40 execute software to determine which of the cars of the elevators 12–14 will service the hall call. Signals indicative of parameters of the elevator group 10, which are used by the software to determine the assignment, are passed among the elevators 12–14 via the interelevator communication links 16–19.

Figure 2:
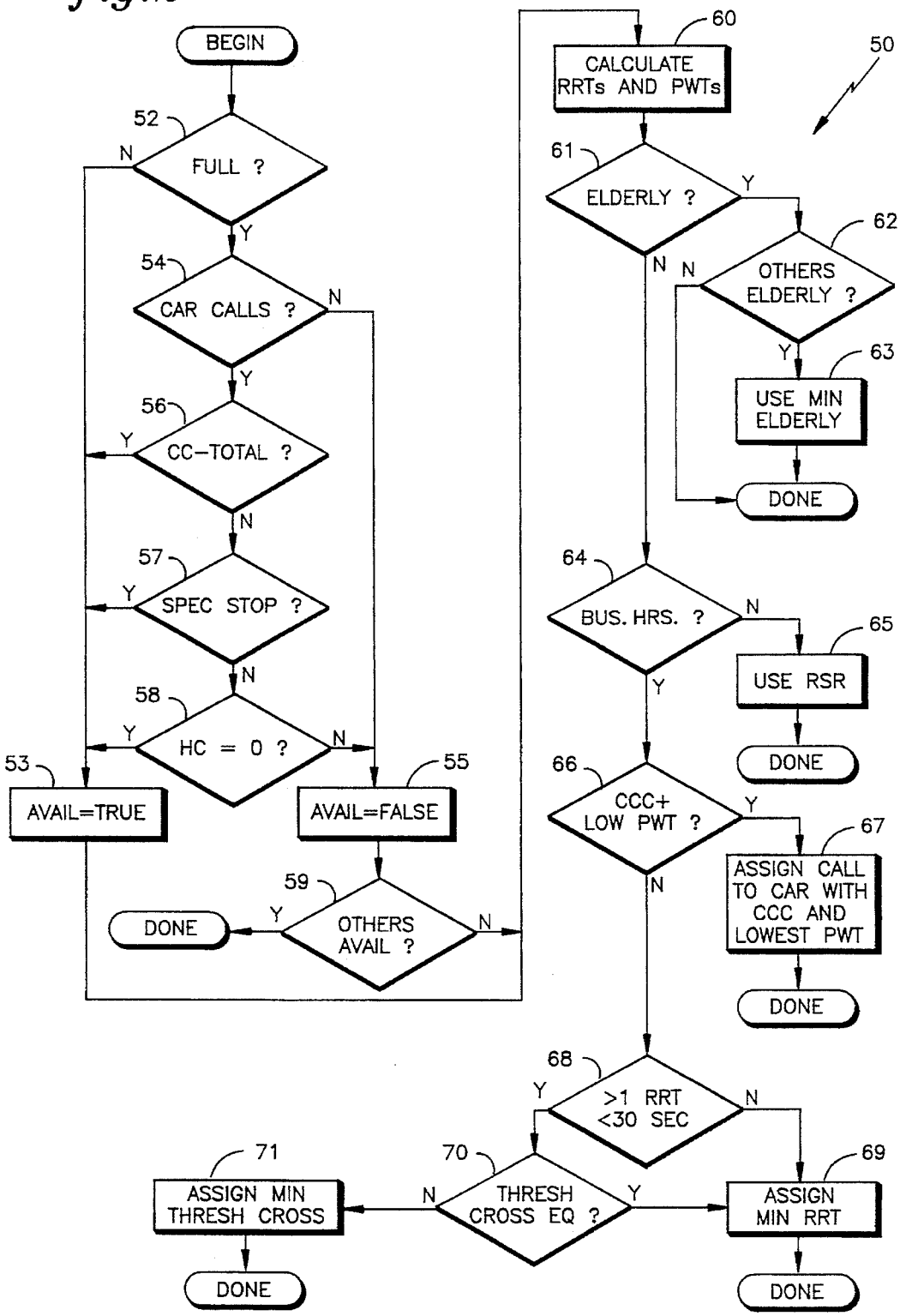
FIG. 2 is a flowchart indicating steps for assigning an elevator car.

Referring to FIG. 2, a flowchart 50 illustrates the process of assigning an elevator car to service a hall call. At a first step 52, a test is made to determine if the elevator car is full. This information is provided by sensors (not shown) and software (not shown), known to those skilled in the art, which determines the number of passengers in an elevator car. If the car is not full, control passes from the step 52 to a step 53, where a variable AVAIL is set to TRUE, indicating the elevator car is available to service a hall call. The value of the AVAIL variable for each elevator car is made available to all of the elevators 12–14 via the interelevator communication links 16–19.

If at the step 52 the car is full, control passes from the step 52 to a step 54, where a test is made to determine if there are any car calls between the present position of the elevator car and the hall call, inclusive of the position of the hall call. If there are no car calls between the present position of the elevator car and the hall call, control passes from the step 54 to a step 55 where the variable AVAIL is set to FALSE, indicating that the car is not available to answer the hall call. Note that if the car is full and there are no car calls between the position of the car and the hall call (to empty the car out) then there is no possibility of the car not being full at the time it would answer the hall call.

If at the test step 54 there are car calls between the present position of the elevator car and the hall call, control passes from the step 54 to a test step 56, where a test is made to determine if all of the car calls are between the position of the elevator car and the hall call, inclusive of the position of the hall call. If all of the car calls are between the position of the elevator car and the hall call, there is a good chance that the car will be empty or nearly empty at the hall call so control passes from the step 56 to the step 53, where the AVAIL variable is set to TRUE.

If, on the other hand, all of the car calls are not between the position of the elevator car and the hall call, control passes from the step 56 to a step 57, where a test is made to determine if there is a special stop car call between the current position of the car and the hall call. A special stop is a cafeteria, lobby, or any other stop where one could normally expect many passengers to exit from the elevator car. If there is a special stop between the current elevator car position and the hall call, the elevator car is deemed available for a hall call and control passes from the step 57 to the step 53. Otherwise, control passes from the step 57 to a step 58, where a test is made to determine if the number of hall calls between the current position of the elevator car and the hall call is zero. If so, then the elevator car is deemed available, and control passes from the step 58 to the step 53. If not, then the elevator car is deemed not available and control passes from the step 58 to the step 55.

Following the step 55, where AVAIL is set to FALSE indicating that the elevator Car is not available for assignment to a hall call, is a test step 59, where a test is made to determine if any of the other cars in the group are available. If at least one other car is available, processing is complete and the hall call will be assigned to one of the available cars. If, on the other hand, all of the cars in the group are unavailable, then an assignment will be made to one of the cars in spite of the unavailability of any of the cars.

Following the test step 59 if no other cars in the group are available or following the step 53 is a step 60, where the remaining response times (RRT) for all of the registered calls for the car, including the present hall call, are determined. RRT is a prediction of the amount of time which will elapse before a hall call is serviced. RRT makes use of the following estimates: A car in motion will take one second to travel from a floor to an adjacent floor, a stopped car will take five seconds to begin moving and reach an adjacent floor, a stop will take ten seconds for passengers to load and unload, and answering a hall call will result in a car call to a terminal floor ending in the direction of the hall call. The RRT for a call is thus determined by summing the time values from the above assumptions.

At the step 60, the hall call is assumed to have been assigned to the car before the new RRTs for all of the registered calls for the car are determined. The predicted waiting time (PWT) for each of the calls is also determined. PWT is calculated by adding the RRT of a call to the amount of elapsed time since the call was registered. Calls which have a PWT greater than a predetermined amount of time, such as sixty seconds, are deemed "elderly". Cars having elderly calls are treated specially, as described in more detail hereinafter.

Following the step 60 is a test step 61, where all of the registered calls for the car are examined to determine if the car has any affected elderly calls which are calls that are made elderly or made more elderly by answering the hall call. If so, control passes from the step 61 to a test step 62 where the state of the other cars is examined to determine if all of the other cars have any affected elderly calls. The existence and duration of affected elderly calls for all of the cars is passed among the elevators 12–14 via the interelevator communication links 16–19. If not all of the other calls not have affected elderly calls, then processing is complete since the hall call will be assigned to one of the other cars which does not have an affected elderly call. Otherwise (i.e., if all of the cars have affected elderly calls), control passes to a step 63 where the maximum affected elderly call for each of the cars is examined. At the step 63, the call is assigned to the car having the smallest maximum affected elderly call.

If at the test step 61 there are no affected elderly calls for the car, control passes from the step 61 to a test step 64 where the current time of day is checked against values which define business hours (nominally seven A.M. to seven P.M.). If the time of day is not within business hours, control passes from the step 64 to a step 65, where the relative system response (RSR) elevator call assignment algorithm is used to determine assignment of the hall call. The RSR algorithm is known in the art and is described fully in a patent to Joseph Bittar titled "Relative System Response Elevator Call Assignments" U.S. Pat. No. 4,363,381

If the time of day is within business hours, control passes from the step 64 to a test step 66 where the registered car calls are examined for a car call coincident with the hall call. If there is a coincident car call (CCC), and if the PWT of the call is a relatively low amount of time (such as forty-five seconds or less), control passes from the step 66 to a step 67, where the call is assigned to the car having the coincident car call and low PWT. If more than one car has a coincident car call and low PWT, the car with the lowest PWT is chosen from among those cars.

If there are no cars with a coincident car call and low PWT, control passes from the step 66 to a step 68, where a test determines if there is more than one car with an RRT for the call of less than thirty seconds. If not, control passes from the step 68 to a step 69, where the car with the minimum RRT for the call is assigned to service the call. For all of the cars, the RRT for the hall call is passed among the elevators 12–14 via the interelevator communication links 16–19.

If there is more than one car with an RRT less than thirty seconds, control passes from the step 68 to a step 70, where a comparison is made of the numbers of threshold crossings for the cars with RRTs for the hall call that are less than thirty seconds. A threshold crossing occurs when servicing a hall call would cause the RRT for other registered calls to go from less than a predetermined amount to greater than the same amount, such as thirty seconds. The threshold crossings for all of the cars are passed among the elevators 12–14 via the interelevator communication links 16–19.

If the minimum number of threshold crossings are equal for two or more cars, control passes from the step 70 to the step 69, where the hall call is assigned to one of the cars with equal numbers of threshold crossings having the minimum RRT for the hall call. If there is only a single car having the minimum number of threshold crossings, control passes from the step 70 to a step 71, where the hall call is assigned to the car with the minimum number of threshold crossings.

The invention illustrated herein is applicable to any elevator system having any number of cars, stopping on any number of floors, having any maximum capacity, maximum velocity, or having any other specific set of physical characteristics. Similarly, the invention may be practiced irrespective of the physical design of the elevator system, including drives, counterweights, cabling, door mechanisms, hall call and car call signaling devices. The examples of special stops used herein are not meant to be exhaustive.

The particular values used for deeming a call elderly, for determining a threshold crossing, and for other specific purposes may be modified by one skilled in the art without departing from the spirit and scope of the invention. The invention may be adapted by one skilled in the art to be used for reassignment of previously assigned hall calls. The exact methodology and times used for determining RRT may be modified without departing from the spirit and scope of the invention.

Portions of the processing illustrated herein may be implemented instead with electronic hardware, which would be straightforward in view of the hardware/software equivalence discussed (in another field) in U.S. Pat. No. 4,294,162 entitled "Force Feel Actuator Fault Detection with Directional Threshold" (Fowler, et al.).

Although the invention has been shown and described with respect to exemplary embodiments thereof, it should be understood by those skilled in the art that various changes, omissions and additions may be made therein and thereto, without departing from the spirit and the scope of the invention.

What is claimed is:

1. A method of dispatching a group of elevator cars in a building including assigning hall calls to available elevator cars for service thereto, comprising, for each specific hall call to be assigned:

for each given car in the group determining if said given car is fully loaded, and if it is not, providing an available signal indicative of the fact that said given car is available to answer hall calls, but if it is fully loaded, determining whether said given car has any registered car calls, and if it has not, resetting said available signal, thereby indicating that said given car is not available to answer hall calls, but if said given car has registered car calls, determining if all of said car calls are intervening car calls between the present position of said given car and said specific hall call, and if so, providing said available signal;

assigning hall calls to cars related to said available signals; and dispatching said cars to answer assigned hall calls.

2. A method according to claim 1 wherein:

if said given car has registered car calls, determining if all of said car calls are intervening car calls between the present position of said given car and said specific hall call, and if not, determining if one of said car calls is for a special stop where many passengers are likely to exit from the elevator car, and if so, providing said available signal.

3. A method according to claim 2 wherein:

if none of said car calls is for a special stop, determining if said given car has any intervening hall calls between the present position of said given car and said specific hall call, and if it does not, providing said available signal, but if it not, resetting said available signal.

4. A method of dispatching a group of elevator cars in a building including assigning hall calls to available elevator cars for service thereto comprising, for each specific hall call to be assigned:

for each given car in the group determining if said given car is fully loaded, and if it is not, providing an available signal indicative of the fact that said given car is available to answer hall calls, but if it is fully loaded, determining whether said given car has any registered car calls, and if it has not, resetting said available signal, thereby indicating that said given car is not available to answer hall calls;

assigning hall calls to cars related to said available signals if any, but allowing said given car to be available to answer hall calls even in the absence of said available signal provided there is no other car in said group with a corresponding available signal.

* * * * *

UNITED STATES PATENT AND TRADEMARK OFFICE

CERTIFICATE OF CORRECTION

PATENT NO. : 5,467,844

DATED : November 21, 1995

INVENTOR(S) : Bruce A. Powell et al

It is certified that error appears in the above-indentified patent and that said Letters Patent is hereby corrected as shown below:

Column 6, line 20, Claim 3: after "signal, but if it" insert --does-- and delete "not".

Signed and Sealed this

Thirtieth Day of July, 1996

Bruce Lehman

*Attest:*

BRUCE LEHMAN

*Attesting Officer*

*Commissioner of Patents and Trademarks*